United States Patent [19]

Mais et al.

[11] 4,030,269

[45] June 21, 1977

[54] FILLING HEAD DETECTION DEVICE

[75] Inventors: James W. Mais, East Cleveland; L. Paul Myers, Munroe Falls, both of Ohio

[73] Assignee: A-T-O Inc., Willoughby, Ohio

[22] Filed: July 12, 1976

[21] Appl. No.: 704,437

[52] U.S. Cl. ..... 53/61

[51] Int. Cl.[2] ..... B65B 57/10

[58] Field of Search ..... 53/61, 62

[56] References Cited

UNITED STATES PATENTS

| | | | |
|---|---|---|---|
| 3,694,993 | 10/1972 | East | 53/61 X |
| 3,965,650 | 6/1976 | Nussbaum | 53/61 X |

*Primary Examiner*—Travis S. McGehee
*Attorney, Agent, or Firm*—Oldham & Oldham Co.

[57] ABSTRACT

The filling head detection device has a stop member at its downstream end for each row of articles supplied thereto, a conductive metallic flag pivotally positioned on the stop member and normally projecting upstream therefrom and being movable to a retracted position by an article moved along the filling head into engagement with a stop member, each flag having a hole therein with such holes being aligned transversely of the filling head. An electrical contact member extends through the holes in the flags and normally is in contact with a wall surface thereof, but with article moving into engagement with the stop members in the individual rows moving the flags to retracted positions to break their electrical contact with the contact member so that operative conditions in an electrical system connecting to the contact device can be varied.

6 Claims, 6 Drawing Figures

FILLING HEAD DETECTION DEVICE

BACKGROUND OF INVENTION

Heretofore in article case packers, efforts have been made to provide controls for the feed of streams of abutted articles to the filling head, and protection or checker devices have been provided heretofore to determine when the filling head or grid on a case packer is properly filled with articles for case packer action.

One prior patent in this field is U.S. Pat. No. 3,421,285 that shows a plurality of stop members for stopping the flow of individual abutted rows of articles along the fitting head as the individual rows thereof are fully occupied with articles. The foremost article in each row contacts and changes the position of a pivotal flag provided in association with the stop. This pivotal movement of the flag opens or clears a laterally extending hole formed in the stop member and flag assembly to permit a wave form control beam, such as a sonic or light beam, to be transmitted through the holes in the stop members and flags to permit it to pass across the width of the filling head when all of the flags are moved to a cleared position. Then the beam can be used for a circuit control function to provide a desired operation in the case packer, such as dropping the group of articles on the filling head into a carrier case.

Typical article caser apparatus such as can be used with the apparatus of the invention or in which such apparatus would be used is shown in prior U.S. Pat. No. 3,052,071.

The previous apparatus, even though it functions quite satisfactorily for some time, does sometimes involve focus problems in the projecting of a light beam across the filling head for the desired control action. Furthermore, some alignment and maintenance problems have been incurred in the past because of vibration of the filling head and somewhat short electric light bulb life has occurred when the light generator and the light receiver are both mounted on the filling head as is customary in the present practice in this art.

It is therefore the general object of the present apparatus to provide a new and improved detection device for use with a case packer filling head and to provide a predetermined control function when the case packer filling head is properly filled with articles for packaging action.

Another object of the invention is to provide a sturdy, substantially maintenance free, electrical control circuit for use with case packer filling heads and article detection devices thereon for controlling the handling of articles on the filling head.

Another object of the invention is to provide a relatively uncomplicated electrical and mechanical article detection device for a case packer filling head to indicate when the head is full of articles; and to provide apparatus of the type described that can be relatively easily mounted on existing apparatus to replace wave form beam control apparatus as provided heretofore in this art.

Other objects and advantages of the invention will be made more apparent as the specification proceeds.

Attention now is directed to the accompanying drawings, wherein.

Figure 2:
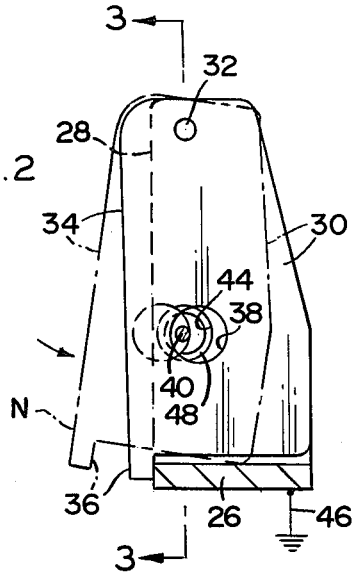
FIG. 2 is a vertical section, taken on line 2—2 of FIG. 1, through a portion of the apparatus showing the control flag in a dotted line normal position and in a solid line retracted position when contacted by a article moved to the end of the filling head.
Figure 3:
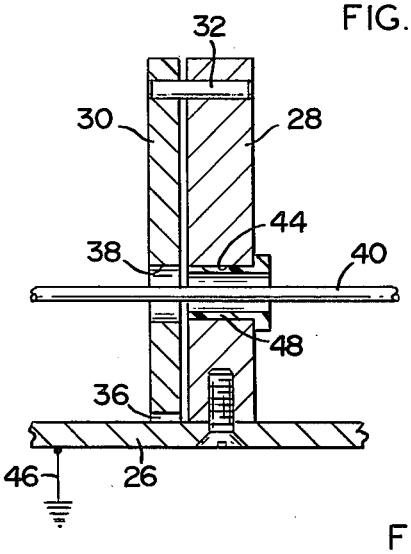
Figure 2A:
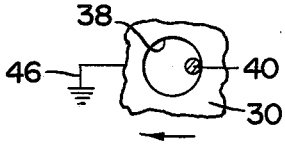
Figure 2B:
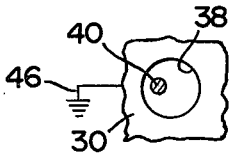

FIG. 2*a* is a diagrammatic fragmentary view of a portion of the pivotal flag member of the stop assembly in its normal position;

FIG. 2*b* is a diagrammatic view like FIG. 2*a*, but with the control flag moved to a retracted non-contacting position when struck and moved by an article moved onto the filling head;

FIG. 3 is a vertical section on line 3—3 of FIG. 2; and

Figure 4:
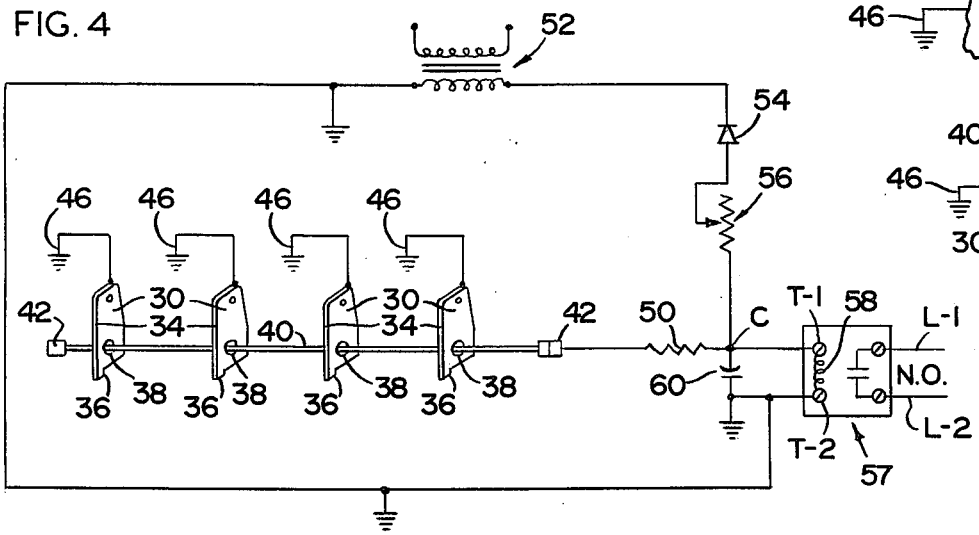

FIG. 4 is a typical wiring diagram of the apparatus of the invention.

When referring to corresponding members shown in the drawings and referring to in the specification, corresponding numerals are used to facilitate comparison therebetween.

The present invention, as one embodiment thereof, relates to a case packer that includes a filling head which has a plurality of rows of abutted articles supplied thereto and pushed downstream thereof, the filling head detection device comprising a stop member at the downstream end of each row of articles as supplied to and moved along the filling head, a conductive metallic flag pivotally carried by each stop member and normally projecting slightly in an up stream direction therefrom to be struck and moved by an article being moved to engagement with a stop member, each flag having a hole therein and each flag being operatively grounded, the stop members and the holes therein for all of the rows being aligned transversely of the filling head. An electrical contact device extends through the holes in the flags and normally is in contact therewith, but articles moving to the downstream end of the filling head moving the flags to a retracted position to break their contact with the contact device so that operative conditions in an electrical system connecting to the contact device can be varied when all of the flags are moved to retracted positions.

Figure 1:
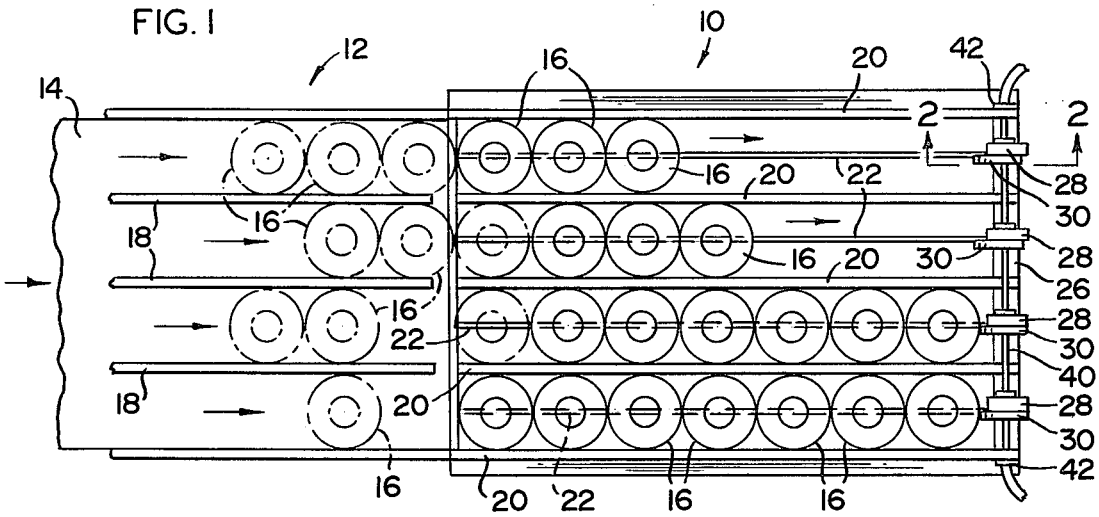
FIG. 1 is a plan view of apparatus embodying the principles of the invention and showing it in association with case packer apparatus.

The filling head or grid, as shown in FIG. 1, is referred to as a whole by the numeral 10, and it is operatively connected to and associated with a case packer indicated as a whole by the numeral 12. Only a portion of the case packer is shown and it includes any suitable type of a conveyor 14 which is driven by conventional means and which has a plurality of rows of abutted articles 16 carried thereby, and retained in rows by conventional means such as partition plates 18.

The particular filling head 10 likewise has suitable partition plates or members 20 extending longitudinally there of to maintain the articles supplied thereto in a butted row form. Filling heads or grids as commercially made and sold today, and as shown in prior patents, in many instances include longitudinally extending slide bars 22 positioned in substantially the centers of the different rows formed in the filling head. These bars are operatively connected into a suitable unitary frame means and means, not shown, are provided to move the assembly of the slide bars laterally with relationship to the filling head 10 so that the bars can be brought into vertical alignment with, and be positioned below, the partition 20 on the filling head. At that time, all articles on the filling head are released and will drop through the filling head for deposit into a carrier case positioned below the filling head in a known manner. The filling head 10 also includes its own frame means 24 which includes a downstream crossbar 26 as a portion of such frame means.

The apparatus of the invention also includes a plurality of stop members or assemblies 28, one of which is positioned at the downstream end of each of the rows of articles provided on the filling head 10. These stop members 28 are carried by the crossbar 26 of the frame, as indicated in FIGS. 2 and 3. Each stop member 28 carries a vertically positioned metallic flag 30 which is pivotally secured to the stop member by a pivot pin 32. Such pin 32 permits relative pivotal movement of the flag 30 from a normal suspended position indicated in N in FIG. 2 wherein the flag extends in an upstream direction with relation to the stop member 28. The stop member 28 has a vertically extending face 34 on the portion thereof facing in an upstream direction. Thus, when articles move along the filling head and reach the downstream end thereof, they engage the individual flag 30 provided at the end of such row of articles. The articles 16 then push the flags in a downstream direction until, for example, a finger flange 36 formed on the lower end of each of the flags engages the crossbar 26.

Each of the flags 30 has a hole 38 formed in a lower portion thereof, and with such holes 38 being aligned transversely of the filling head when the flags 30 are all in their normal operative positions, as determined by the stop members and filling head assembly. A contact rod, member or device 40 is suitably carried by the filling head 10, and it is positioned by members such as supports 42 on the frame means 24 for the filling head. These supports 42 have the contact member 40, which preferably is a rigid metal rod, extend transversely of the filling head and through holes 44 formed in the stop members 28. The contact rod 40 likewise extends through the holes 38 in the individual flags 30. The size of the contact member or rod 40 in relationship to the holes 38 and the movement provided for the flags 30 in the apparatus in such that, in the embodiment of the apparatus shown herein, the contact rod 40 engages a wall or surface of the flag 30 when the flag has moved to its protruding normal position extending slightly upstream from the associated stop member 28. However, as indicated in FIG. 2b, when the flag has been moved downstream, then the contact rod 40 is out of engagement with any surface of the flag and an electrical condition has been changed. Each of the flags is grounded in a suitable manner as indicated at 46, and the change in electrical conditions on the filling head can be used for a control function.

These flags 30 may have individual ground circuits provided therefor as indicated in FIG. 4, or only one ground circuit can be provided for the frame means 24, depending upon the control circuit conditions and exactly the control function desired in the filling head and the detection device of the invention. The flags 30 are conductive as are the pin 32 and stop members 28 which are on the metal filling head frame 24.

FIG. 3 of the drawings best shows that an insulating sleeve 48 is positioned in each of the stop members in the hole 44 therein, whereby the contact member 40 will not electrically engage the stop member at any time.

FIG. 4 shows a typical control circuit that can be operatively engaged with the apparatus of the invention to be controlled or actuated thereby. Thus, the figure shown the contact member or rod 40 secured to a support 42 and it has the circuit connected thereto in any conventional manner, as by a plug-in connection. The circuit connects through a resistance 50 to a connector point C. Power is supplied to the control circuit, as by a transformer 52, and direct current power supply passes through a rectifier 54 and a potentiometer 56 to the connector point C.

The control circuit includes conventional means such as a solid state relay 57, which is energized by a DC control voltage supplied from the transformer 52 through the rectifier 54. An operative coil 58 is provided for this relay and current or power is shunted away from the solid state relay via the resistor 50 and the grounded circuit connected thereto through the flags 30 and ground lead 46. Hence, when one of the flags 30 is in its normal grounded position, this completes the electrical path from the contact rod 40 to the ground. A capacitor 60 is connected between terminals T-1 and T-2 of the relay to provide a short time delay before the solid state to relay 57 is energized. This time delay is beneficial in eliminating false signaling occuring due to any random bouncing of the flags wherein electrical contact with the detection wire or contact rod 40 is briefly lost. Leads L-1 and L-2 connect to a normally open switch or circuit controlled by the relay 57, and closed when the relay is energized. The leads L-1 and L-2 connect to any suitable control circuit for providing, usually, a desired control function in the filling head 10 and associated means when the relay 57 is energized from the filling head circuit. Normally, the control function would be to provide a drop of the articles grouped in a satisfactory manner on the filling head for deposit into the associated carrier case by moving the slide bars 22 laterally to drop positions.

It should be appreciated that other control systems can be set up to be varied by changing the operative conditions of the contact rod 40 in relationship to the flags 30 that are individually moved into and out of contact with such contact rod for changing the electrical circuit means and conditions so as to open, or close, or vary the electrical conditions applied to a control relay so that the control function can be obtained when all of the flags 30 have been moved from a normal upstream position to the retracted or operative position, as indicated in FIG. 2.

The apparatus of the invention is relatively sturdy and has low maintenance requirements. No electric bulbs need be positioned on the filling head 10, or any associated parts, and there are no alignment problems in the control means. The apparatus is not nearly as delicate as when an electric light beam and photoelectric cell are used for the control function in combination with the movable flags provided on a filling head. Thus, it is believed that the objects of the invention have been achieved.

While one complete embodiment of the invention has been disclosed herein, it will be appreciated that modification of this particular embodiment of the invention may be resorted to without departing from the scope of the invention.

What is claimed is:

1. In a case packer including a filling head adapted to have a plurality of rows of abutted articles supplied thereto and pushed downstream thereof, a filling head detection device comprising a stop member at the downstream end of each row of articles as supplied to and moved along the filling head, a conductive metallic flag pivotally carried by each of said stop members and normally projecting slightly in an upstream direction to be struck by an article before it is moved into engagement with a said stop member, each said flag having a hole therein, the stop members and the flags for all of said rows being aligned transversely of said filling head, and an electrical contact device extending through the holes in said flags, articles moving to the downstream end of the filling head also moving said flags to retracted positions to change their physical and electrical relation with said contact device whereby the operative conditions in an electrical system connecting to said contact device can be varied when all of said flags are moved to retracted positions.

2. A filling head detection device as in claim 1 where a control circuit operatively connects to said flags and to said electrical contact to change operative conditions in said control circuit when all of said flags are moved to their downstream positions.

3. A filling head detection device as in claim 1 where said flags are each individually operatively connected to ground, said contact device electrically engages each of said flags when in its normal position and is out of electrical engagement with said flags when moved to their downstream positions.

4. A filling head control circuit as in claim 3 where said flags and the ground circuits therefor are connected in parallel with each other and in series with said contact device.

5. In a case packer including a filling head having a plurality of rows of abutted articles supplied thereto and pushed downstream thereof while retained in row form, a filling head detection device comprising a frame for the filling head, a stop member on the frame at the downstream end of each row of articles provided on the filling head, a vertically positioned metallic flag pivotally carried by each of said stop members and normally projecting slightly in an upstream direction to be struck and moved downstream by an article before it is moved into engagement with a said stop member, each said flag having a hole therein at a lower portion thereof and being operatively connected to an electrical ground, the stop members and the metallic flags for all of said rows being aligned transversely of said filling head, an electrical contact member extending through said stop members and insulated therefrom, said contact member also extending through the holes in said flags and normally being in contact with surfaces of such holes, articles moving towards a said stop member also moving its said flag to a retracted position and breaking its contact with said contact member whereby operative conditions can be varied in an electrical system connecting to said contact member when all of said flags are moved to retracted positions.

6. In a case packer as in claim 5 and including a control circuit for changing said filling head to drop articles therethrough connected to said contact member and to said flags to be actuated to release articles on said filling head when all of said flags are moved to their retracted positions.

* * * * *

UNITED STATES PATENT OFFICE

CERTIFICATE OF CORRECTION

PATENT NO. : 4,030,269

DATED : June 21, 1977

INVENTOR(S) : James W. Mais and Paul Myers

It is certified that error appears in the above-identified patent and that said Letters Patent are hereby corrected as shown below:

Column 2, line 4, delete "a" and insert --an--.

Column 2, line 53, delete "there of" and insert --thereof--.

Column 3, line 67, delete "shown" and insert --shows--.

Signed and Sealed this

*Twenty-seventh* Day of *September 1977*

[SEAL]

*Attest:*

RUTH C. MASON
*Attesting Officer*

LUTRELLE F. PARKER
*Acting Commissioner of Patents and Trademarks*